US006253735B1

(12) United States Patent
Miyajima

(10) Patent No.: US 6,253,735 B1
(45) **Date of Patent: *Jul. 3, 2001**

(54) FUEL FEEDING DEVICE

(75) Inventor: Masayasu Miyajima, Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/432,186

(22) Filed: Nov. 2, 1999

(30) Foreign Application Priority Data

Apr. 27, 1999 (JP) ..... 11-120684

(51) Int. Cl.[7] ..... F02M 41/00
(52) U.S. Cl. ..... 123/456; 123/179.17
(58) Field of Search ..... 123/450, 456, 123/179.17, 198 F, 514, 446

(56) References Cited

U.S. PATENT DOCUMENTS 4,083,345 * 4/1978 Davis ..... 123/450
4,530,324 * 7/1985 Tanaka ..... 123/450
4,674,448 * 6/1987 Steiger ..... 123/446
5,404,855 * 4/1995 Yen ..... 123/456
5,558,068 * 9/1996 Kunishima ..... 123/179.17
5,598,817 2/1997 Igarashi et al. ..... 123/179.17
5,758,622 * 6/1998 Rembold ..... 123/179.17
5,884,597 * 3/1999 Hiraku ..... 123/179.17
5,975,056 * 11/1999 Augustin ..... 123/456
5,983,863 * 11/1999 Cavanagh ..... 123/456

FOREIGN PATENT DOCUMENTS 7-83134 3/1995 (JP) ..... F02M/37/00

* cited by examiner

*Primary Examiner*—Carl S. Miller
(74) *Attorney, Agent, or Firm*—Sughrue, Mion, Zinn, Macpeak & Seas, PLLC

(57) ABSTRACT

In order to reduce load placed on an engine by suppressing loss of the engine power, the fuel feeding device is arranged to comprise a check valve and a two-port connecting valve and further comprises a branch passage for connecting a portion between the check valve and a deliver side of a pumping element with a low pressure and high pressure passage so that the branch passage is opened through operation of the two-port connecting valve when amount of fuel required by the engine is small.

4 Claims, 6 Drawing Sheets

FUEL FEEDING DEVICE

BACKGROUND OF THE INVENTION

1. Field of the Invention

The present invention relates to a fuel feeding device used for an in-cylinder injection type engine and is particularly related to a fuel feeding device adapted for reducing the power of pump for pressurizing the fuel to a high pressure.

2. Description of the Prior Art

A Diesel engine is widely known as an engine of a type with fuel injected within a cylinder called an in-cylinder fuel injection type engine or direct fuel injection type engine, but recently for a spark ignition type engine (gasoline engine) too, the in-cylinder fuel injection type is proposed. An ability to inject fuel with a sufficiently high pressure is required for such an in-cylinder fuel injection type engine.

FIG. 5 shows a fundamental arrangement of a conventional fuel feeding device wherein the fuel which is pressurized to a low pressure by a low pressure fuel pump 2 is regulated to a predetermined low pressure by a low pressure regulator 2 and fed to the pumping element 20A of a high pressure pump 20 from a low pressure fuel passage 8. The pumping element 20A pressurizes the fuel mentioned above to a high pressure and delivers it to a high pressure fuel passage 9. This high pressure fuel is regulated to a predetermined high pressure by a high pressure regulator 11 provided in the high pressure fuel passage 9 and is injected with predetermined timing into respective combustion chambers 22 of engine 21 after being conveyed to a delivery pipe 6 as shown by FIG. 6. Now, part of the fuel flowing through the high pressure fuel passage 9 is returned back to a fuel tank 1 through a drain passage 13 of the high pressure regulator. Up and down motion of piston of the engine 21 is transmitted to the pumping element 20A through a camshaft 25 and this transmitted motion drives an unshown piston thereby pressurizing the fuel which is sucked into the high pressure pump 20.

Since the pumping element 20A of the fuel feeding device mentioned above drives the pump proportionally to the revolution number of the camshaft 25 of the engine 21, disregarding loss, fuel having a volume proportional to the engine rotation number is pressurized and delivered. Accordingly, the pumping element 20A pressurizes and delivers the same amount of fuel regardless of whether the amount of flow required by the engine is large or small. As a result, a large amount of fuel which is already pressurized to a high pressure is obliged to be returned back to the tank 1 from the drain passage 13 of the high pressure regulator even when the amount of fuel required by the engine is small, and thus particularly during a low loading operation there gives rise to a problem of producing a large power loss of the pump.

Also an engine, which exhibits a large change in the amount of fuel which is required depending on engine load as is seen in a lean burn engine and an engine with a turbo changer has a large power loss resulting in a degradation in fuel consumption. The present invention was made to overcome problems posed in the conventional arts as above. The object of the present invention is to provide a fuel feeding device which reduces engine load by suppressing power of pump for pressurizing fuel to a minimum and thus improving the fuel consumption performance.

SUMMARY OF THE INVENTION

A fuel feeding device according to claim 1 comprising multiple pumping elements for pressurizing the fuel to a predetermined pressure and for delivering the pressurized fuel which is provided with means for stopping the function of at least one of said pumping elements depending on the amount of fuel required by an engine.

In a fuel feeding device according to claim 2, the means for stopping the function of said pumping element(s) is arranged to consist of a two-port connecting valve and a check valve.

In a fuel feeding device according to claim 3, the two-port connecting valve is arranged to be normally opened.

In a fuel feeding device according to claim 4, wherein multiple pumping elements are arranged in the same casing.

In a fuel feeding device according to claim 5, the means for stopping function of said pumping element(s) are arranged in the same casing.

DESCRIPTION OF THE PREFERRED EMBODIMENTS

Descriptions will be subsequently given of Embodiments with reference to drawings.

Embodiment 1

Figure 1:
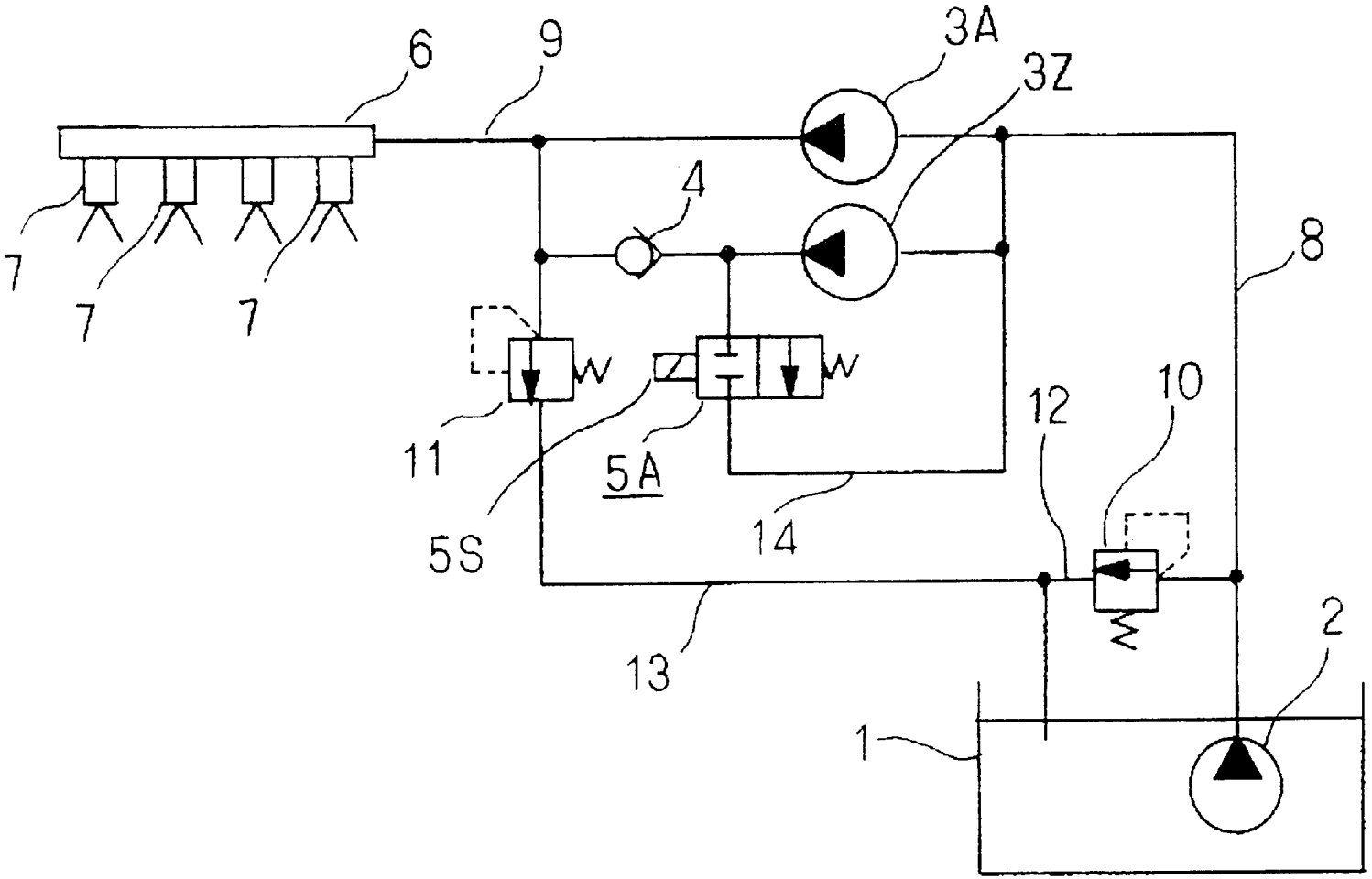
FIG. 1 shows an arrangement of a fuel feeding device according to the first Embodiment.

FIG. 1 shows a schematic diagram of a fundamental arrangement of a fuel feeding device according to the first Embodiment, wherein 1 is a fuel tank comprising a low pressure fuel pump 2; 3A, 3Z are the first and second pumping elements, respectively being arranged in parallel to each other for pressurizing fuel to be fed to an engine to a predetermined high pressure and delivering it; 4 is a check valve, 5A is a two-port connecting valve of a normally closed type, and the check valve 4 together with the two-port connecting valve 5A comprise means for stopping the function of the second pumping element mentioned above; 6 is a fuel injection unit comprising a delivery pipe having the number of injectors 7 corresponding to number of cylinders of unshown engine, 8 is low pressure fuel passage for connecting the delivery side of the low pressure fuel pump 2 with the fuel intake side of the first and second pumping elements 3A, 3Z; 9 is a high pressure passage of fuel for connecting the delivery side of the first and second pumping elements 3A, 3Z and the delivery pipe 6; 10 is a low pressure regulator for regulating the pressure of fuel to be conveyed from the low pressure fuel pump 2; 11 is a high pressure regulator which is disposed in the high pressure fuel passage 9 and which regulates the pressure of the high pressure fuel delivered from the first pumping element 3A or delivered from both of the first pumping element 3A and the second pumping element 3Z; 12 is drain passage of the low pressure regulator 10, and 13 is drain passage of the high pressure regulator 11 and these drain passages 12 and 13 are unified to a common passage connected to the fuel tank 1.

Also, 14 is a branching passage branches at a portion between the check valve 4 and the delivering side of the second pumping element 3Z and is connected with the low pressure fuel passage 8 through the two-port connecting valve 5A.

The check valve 4 is disposed between the delivering side of the second pumping element 3Z and the high pressure fuel passage 9 and performs a function of preventing the fuel, which is delivered from the first pumping element 3A and conveyed to the high pressure fuel passage 9, from flowing into the side of pumping element 3Z.

The two-port connecting valve 5A is a sort of electromagnetic valve arranged in the branch passage 14 and is adapted to close the branch passage 14 during non-electricity supply to the solenoid; and accordingly the valve 5A is called a two-port connecting valve of a normally closed type.

By turning on the electricity to the solenoid, the electromagnetic valve is opened and in turn the two-port connecting valve 5A opens the branch passage 14 thereby pressurizing operating of the pumping element 3Z is put to be stopped and the low pressure fuel sucked in the pumping element 3Z is returned to the low pressure passage 8 through the branch passage 14; by turning off the electricity to the solenoid 5S, the branch passage 14 is closed and the pumping element 3Z is put to an operation of pressurizing the fuel.

In FIG. 1, in order to clearly illustrate the present invention, elements which are usually installed in the fuel feeding device such as pulsation absorbing elements, e.g, high pressure damper and low pressure damper and filters are deleted from it. Though there may be a case where a check valve is provided on the delivering side too of the first pumping element 3A to improve a starting performance, in order to clearly depict the function of the check valve 4 with respect to the means for stopping delivery provided to the second pumping element 3Z, an arrangement with a check valve on the delivery side of the first pumping element 3A deleted is shown as an example in FIG. 1.

A description will be subsequently given of operation of the fuel feeding device having the above mentioned arrangement.

First of all, description will be given of a case where the amount of fuel required by an engine is large so that both of the first pumping element 3A and the second pumping element 3Z are operated.

The fuel is pressurized to a low pressure by a low pressure pump 2 and then the pressurized fuel is regulated to a predetermined low pressure by the pressure regulator 10 and this regulated fuel is conveyed to the intake side of the first pumping element 3A and that of the second pumping element 3Z from the low pressure fuel passage 8. During this process because no electricity supplied to the solenoid 5S, the two-port connecting valve 5A of normally closed type disposed in the branch passage 14 is under the condition of being closed, and thus the branch passage 14 is closed. Then the second pumping element 3Z performs the pressurizing operation, and the fuel is pressurized by the first pumping element 3A and the second pumping element 3Z respectively, delivered to the high pressure regulator 11, conveyed to the delivery pipe 6 and after that injected into combustion chambers of unshown engine from the injector 7 with a predetermined timing.

When pressure of the fuel flowing through the high pressure fuel passage 9 exceeds a high pressure set value which is set at the high pressure regulator 11 as above, a part of the fuel within the high pressure fuel passage 9 is returned back to the fuel tank 1 from the regulator 11 through the drain passage 13. Likewise, when the pressure of the fuel flowing through the low pressure fuel passage 8 exceeds the set value which is set at the low pressure regulator 10, a part of the fuel within the low pressure fuel passage 8 is returned back to the fuel tank 1 through the drain passage 12.

On the other hand, when the amount of fuel required by an engine is small, the pressurizing operation of the second pumping element 3Z is put to be stopped by opening the branch passage 14 by means of turning on the electricity to the solenoid **5*s* of the two-port connecting valve. By opening the branch passage 14, the delivering side of the second pumping element 3Z and the low pressure fuel passage 8 are connected through, then pressure at the delivering side is reduced and as a result, low pressure fuel sucked into the second pumping element 3Z passes through the pumping element 3Z without being pressurized and is returned back to the low pressure fuel passage 8 through the branch passage 14. In this instance only the high pressure fuel pressurized by the first pumping element 3A is delivered to the high pressure fuel passage 9**.

In this way, since the pressurizing operation of the pumping element 3Z is ceased, the work done by unshown pistons of the pumping element 3Z becomes zero and thus the power consumed by the pump for pressurizing fuel can be suppressed to minimum.

The check valve 4 is provided on the side of delivering of the pumping element 3Z and therefore the pressurized high pressure fuel by the first pumping element 3A can not flow into the pumping element 3Z and the branch passage 14.

In this way, according to the first Embodiment, the fuel feeding device comprises the first and second pumping elements 3A and 3Z which pressurize fuel to be fed the engine to a predetermined high pressure and deliver it, the check valve 4 and the two-port connecting valve 5A are provided on the side of delivery side of the second pumping element 3Z, and the branch passage 14 which connects a portion between the check valve 4 and the delivery side of the pumping element 3Z with the low pressure passage 8, is provided; thus when the amount of fuel required to be fed to the engine is small, pressurizing operation of the second pumping element 3Z is put to be stopped by opening the branch passage 14 by operating the two-port connecting valve 5A thereby power of the pump for feeding fuel can be suppressed to minimum resulting in avoiding power reduction more than being inevitable and also avoiding degradation in fuel consumption.

Also since two pumping elements are made under an identical specification, parts constituting those pumping elements can be brought to be standardized.

Embodiment 2

Figure 2:
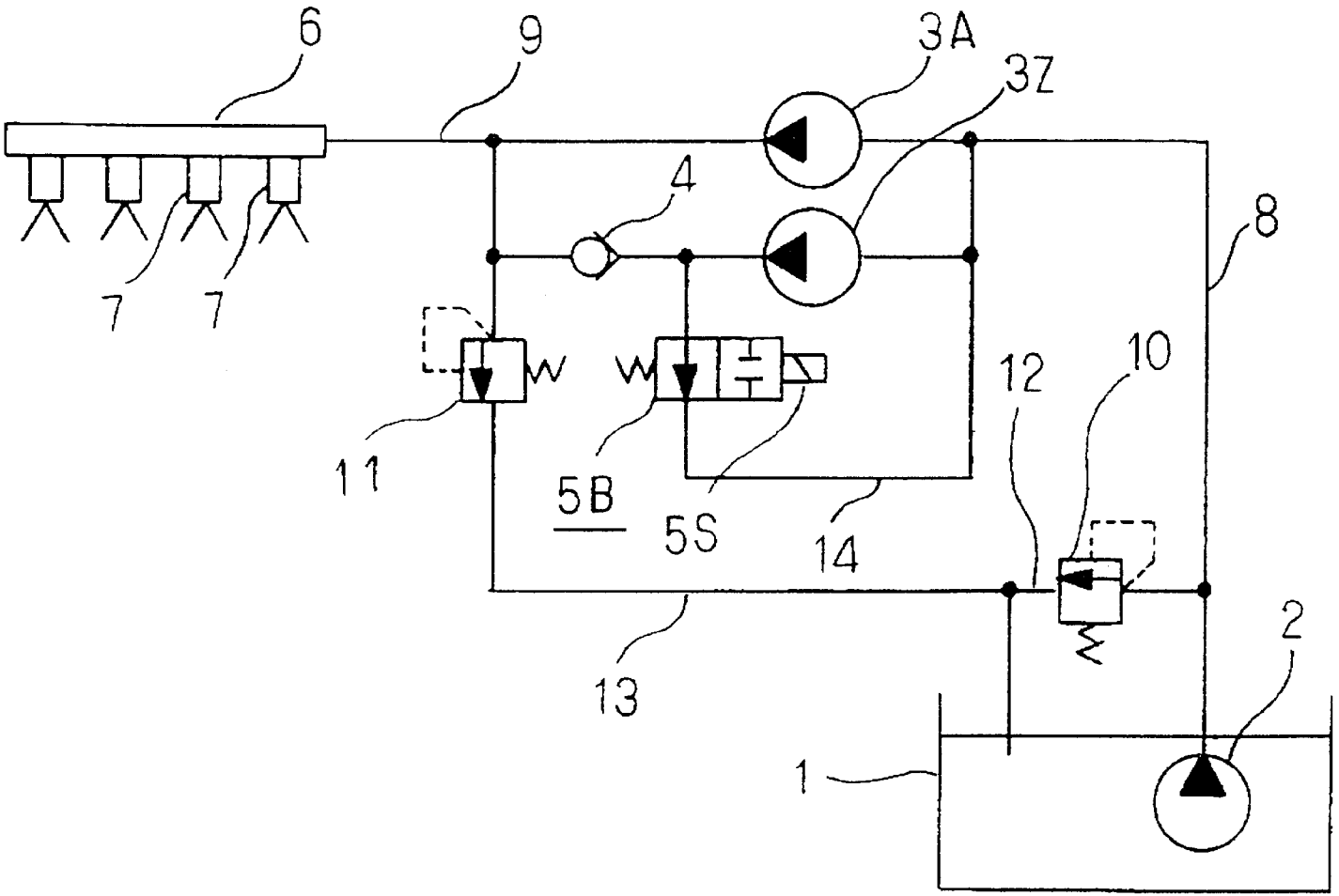
FIG. 2 shows as arrangement of a fuel feeding device according to the second Embodiment.

Through according to the first Embodiment opening and closing of the branch passage 14 is performed by means of the two-port connecting valve 5A of a normally closed type, in the second Embodiment instead of the above mentioned two-port connecting valve 5A, normally opened type two-port connecting valve 5A is used to reduce the engine load when the amount of fuel required by the engine is small as shown by FIG. 2.

The normally opened two-port connecting valve 5B is a type of electromagnetic valve such that it is opened when there is no electricity supply to the solenoid **5*s*, and the pumping element 3Z is put in pressurizing operation by closing the branch passage 14 by supplying electricity to the solenoid 5*s* and the pressurized high pressure fuel is delivered to the high pressure fuel passage 9; and by stopping the electricity supply to the solenoid 5*s*, the branch passage 14 is opened and pressurizing operation of the pumping element 3Z is stopped and thereby the fuel sucked into the pumping element 3Z is returned back to the low pressure fuel passage 8 through the branch passage 14**.

Accordingly, by employing the two-port connecting valve 5B of normally opened type contrary to the use of the above mentioned two-port connecting valve 5A, electricity to the solenoid 5*s* is arranged to be turned on when the amount of fuel required by the engine is large, i.e. engine output is high and electricity supply is arranged to be turned off when the engine output is low, thereby effect of the two-port connecting valve exerted on the engine load can be relieved.

Embodiment 3

Figure 3:
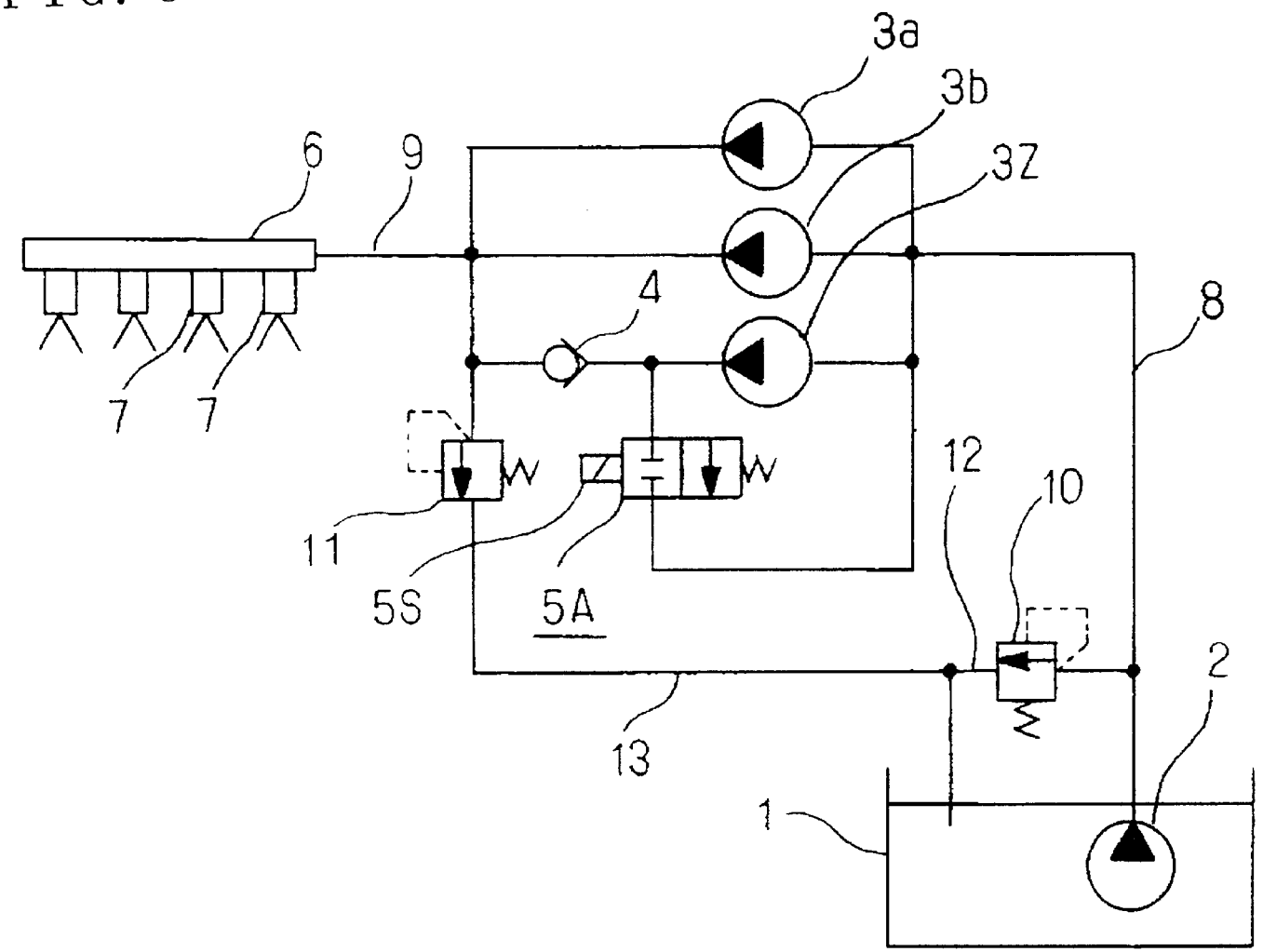
FIG. 3 shows an arrangement of a fuel feeding device according to the third Embodiment.

According to the first and second Embodiments, the second pumping element 3Z is adapted to stop its fuel delivering function depending on the amount of fuel required by the engine by employing such an arrangement that the first and second pumping elements 3A and 3*z* are provided and also means for stopping delivering function which comprises the check valve 4 and the two-port connecting valve 5A (or two-port connecting valve 5B) to the second pumping element 3Z is provided. But as shown by FIG. 3 the same effect as the one obtained through the first and second Embodiments will be produced by providing the second pumping element 3Z comprising two pumping elements 3*a*, 3*b*, which perform a sustained continuous pressurizing operation and have a capacity smaller than that of the first pumping element 3A, and means for stopping of delivery function which consist of the check valve 4 and the two-port connecting valve 5A (or two-port connecting valve 5B)

The number of pumping elements which perform a sustained continuous pressurizing operation, that of pumping elements having means for stopping delivering function and capacity of the pumping elements are to be determined suitably depending on change of the amount of fuel flow required by an engine and depending on setting of the target to be attained for reduction of power loss of the pump, and thus more than three pumping elements under sustained operation may be used. Also a plurality of pumping elements having means for stopping delivering function can be used and the foregoing means for stopping delivering function can be provided to all of the pumping elements. However, it is needless to say that at least one pumping element should be controlled to perform pressurizing operation when the check valves 4 and the two-port connecting valves 5A (two-port connecting valve 5B) are provided to all of the pumping elements.

Embodiment 4

Figure 4:
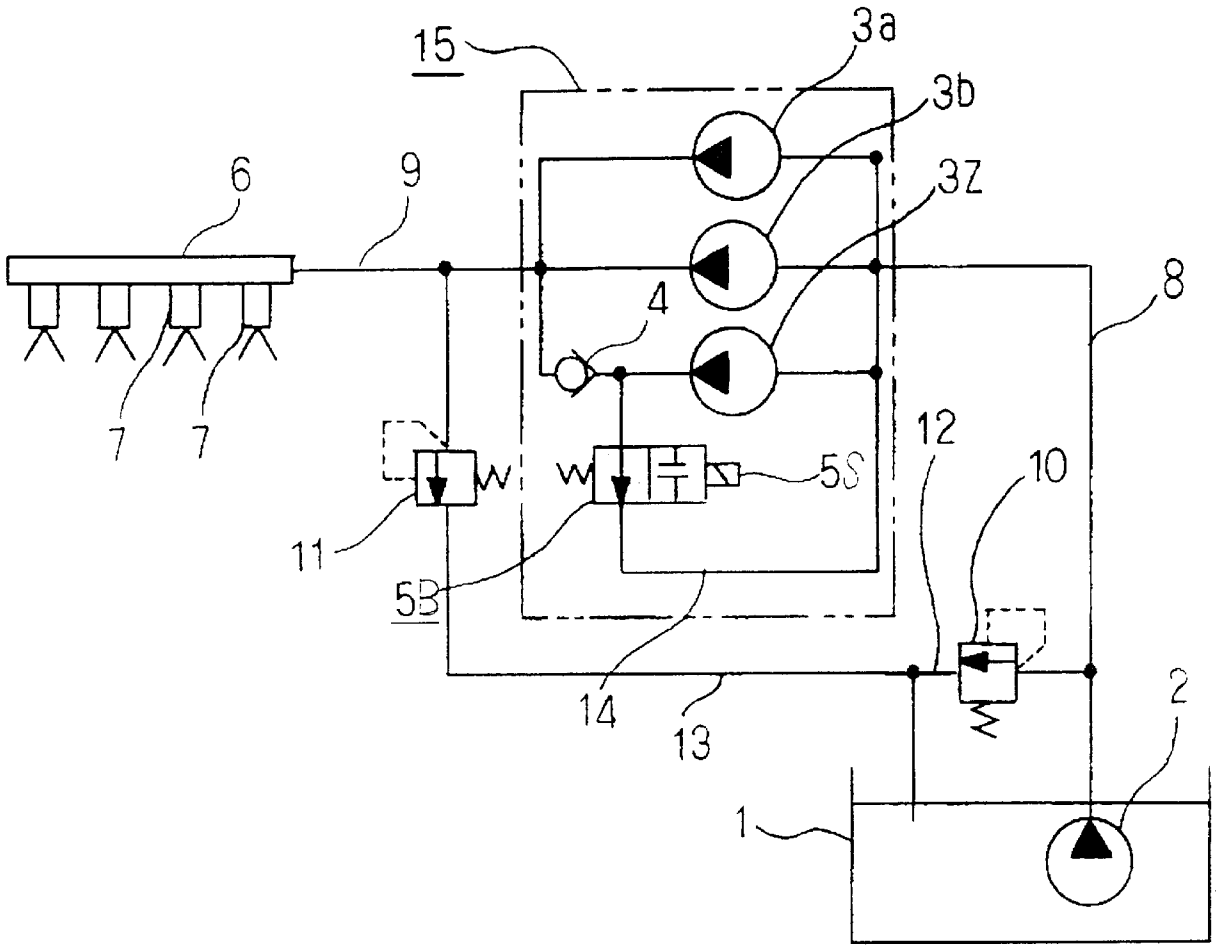
FIG. 4 shows an arrangement of a fuel feeding device according to the fourth Embodiment.
Figure 5:
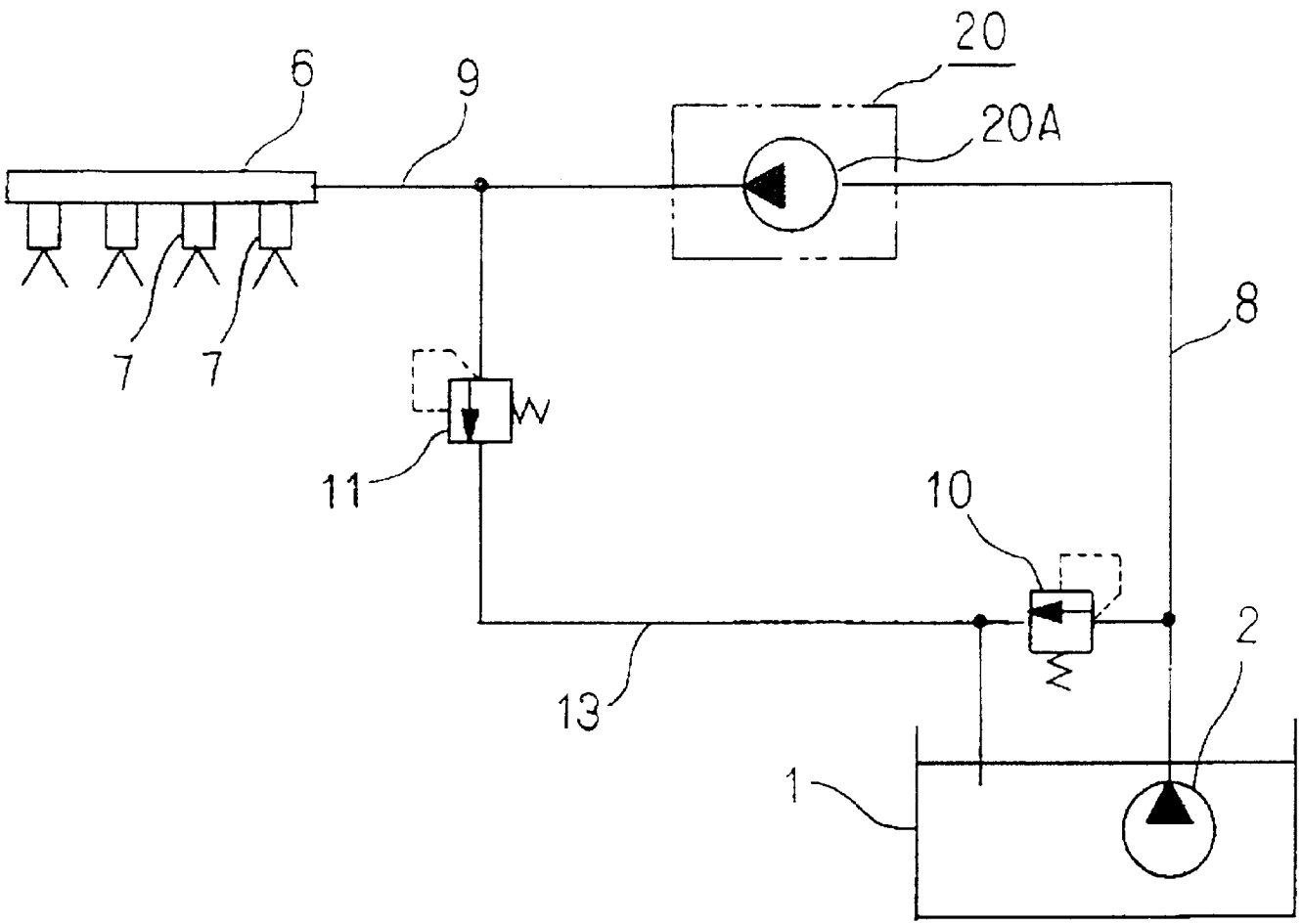
FIG. 5 PRIOR ART
FIG. 5 shows an arrangement of a conventional fuel feeding device.
Figure 6:
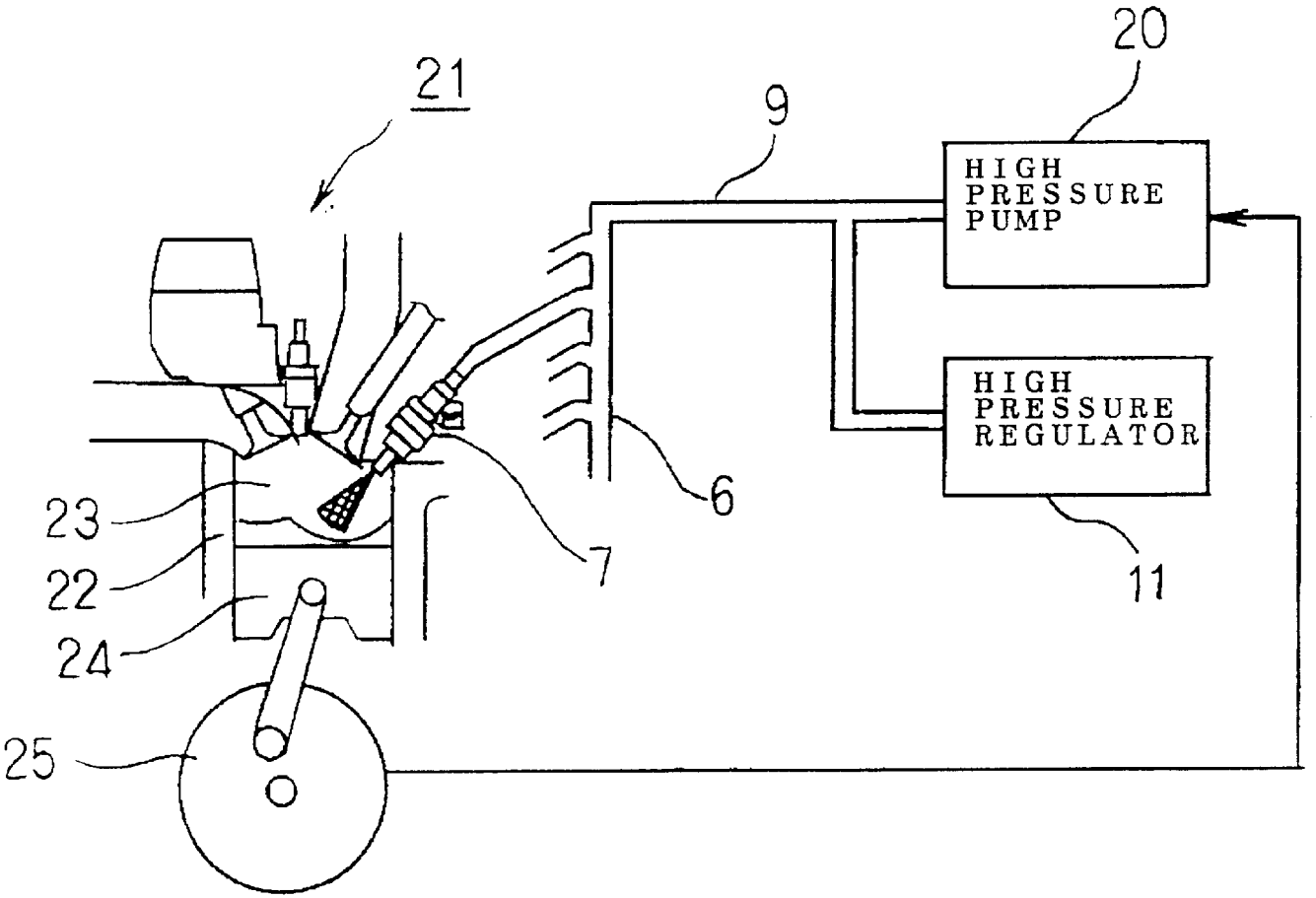
FIG. 6 is a schematic diagram showing a relation between an injector and an engine.

FIG. 4 is a schematic diagram showing a fundamental arrangement of the fuel feeding device according to the fourth Embodiment of the present invention. In FIG. 4, 1 is a fuel tank comprising a low pressure fuel pump 2; 3*a*, 3*b*, 3Z are pumping elements which are arranged in parallel mutually and which pressurize the fuel to be fed to an engine to a predetermined pressure and deliver it; 4 is a check valve and 5 is a two-port connecting valve of normally opened type and the check valve 4 and the two-port connecting valve constitute means for stopping delivering function for the pumping element 3Z as above mentioned; 6 is a delivery pipe, 7 is an injector, 8 is a low pressure fuel passage, 9 is a high pressure fuel passage, 10 is a low pressure regulator, 11 is a high pressure regulator, 12 is a drain passage of a low pressure regulator 10, and 13 is a drain passage of the high pressure regulator 11. According to the fourth Embodiment of the present invention, pumping elements 3*a*, 3*b*, 3Z and the check valve 4 and the two-port connecting valve 5B both of which constitute means for stopping delivering function of the pumping element 3Z are stored in the same casing, thereby piping among pumping elements 3*a*, 3*b*, 3Z, etc., can be shortened and also reduction in size and weight of the fuel feeding device can be realized.

As mentioned above according to the invention as set forth in claim 1, the fuel feeding device comprising multiple pumping elements for pressurizing the fuel to a predetermined pressure and for delivering said pressurized fuel and which is provided with means for stopping the function of at least one of said pumping elements depending on the amount of fuel required by an engine, and this device is adapted not to perform pressurizing function of at least one of the pumping elements when the amount of fuel required by the engine is small, and thus power of the pump for fuel feeding can be suppressed to minimum. As a result, reduction of engine load can be attained and also improvement in fuel consumption can be realized.

According to the invention as set forth in claim 2, the means for stopping the delivering function is arranged to consist of a two-port connecting valve and a check valve, and therefore a simple arrangement enables to stop the delivering function of the respective pumping element.

According to the invention as set forth in claim 3, the two-port connecting valve is arranged to be normally opened, and therefore, when the engine output is small, the effect exerted on the engine load by the two-port connecting valve operation can be relieved.

According to the invention as set forth in claim 4, multiple pumping elements are arranged in the same casing, and therefore the piping can be shortened and also reduction in size of the fuel feeding device can be attained.

According to the invention as set forth in claim 5, the means for stopping delivering function are arranged in the same casing, and therefore further reduction in size of the fuel feeding device can be promoted.

What is claimed is:

1. A fuel feeding device comprising:

multiple pumping elements for pressurizing fuel to a predetermined pressure and for delivering said pressurized fuel;

regulating means for regulating pressure in high and low pressure fuel passages;

draining means for draining said high and low pressure fuel passages after operation of said regulating means; and means for selectively enabling and disabling the function of at least one of said pumping elements depending on the amount of fuel required by an engine said means comprising a two-port connecting valve and a check valve.

2. A fuel feeding device according to claim 1, wherein said two-port connecting valve is arranged to be normally opened.

3. A fuel feeding device according to claim 1, wherein multiple of said pumping elements are arranged in the same casing.

4. A fuel feeding device according to claim 3, wherein said means for stopping function of said pumping element(s) are arranged in the same casing.

* * * * *